US008789911B2

(12) United States Patent
Takenouchi

(10) Patent No.: US 8,789,911 B2
(45) Date of Patent: Jul. 29, 2014

(54) IMAGE FORMING DEVICE

(75) Inventor: Yoshikuni Takenouchi, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 245 days.

(21) Appl. No.: 13/536,072

(22) Filed: Jun. 28, 2012

(65) Prior Publication Data

US 2013/0002750 A1 Jan. 3, 2013

(30) Foreign Application Priority Data

Jul. 1, 2011 (JP) ..... 2011-146928

(51) Int. Cl.
*B41J 29/393* (2006.01)

(52) U.S. Cl.
USPC ..... 347/16; 347/19

(58) Field of Classification Search
CPC .... B41J 11/001; B41J 11/0025; B41J 11/003; B41J 11/0045; B41J 11/009; B41J 15/00; G03G 15/00
See application file for complete search history.

(56) References Cited

U.S. PATENT DOCUMENTS 5,850,235 A * 12/1998 Saito et al. ..... 347/22
8,262,217 B2 * 9/2012 Furukawa ..... 347/104
8,636,332 B2 * 1/2014 Saita ..... 347/16

FOREIGN PATENT DOCUMENTS

JP 2002-244493 8/2002
JP 2003-276288 9/2003
JP 2007-076791 3/2007

* cited by examiner

*Primary Examiner* — Lamson Nguyen
(74) *Attorney, Agent, or Firm* — Hamre, Schumann, Mueller & Larson, P.C.

(57) ABSTRACT

An image forming device includes a paper feed unit formed of plural paper feed trays wherein a different kind of print medium is contained in each paper feed tray, a communication unit that receives a print job using at least two different kinds of print media, a print job analysis unit, and a paper feed tray selection unit that, when a result of an analysis by the print job analysis unit is that the use of a specific paper feed tray is designated for one portion of data among the data in the print job, selects the designated paper feed tray from among the plural paper feed trays as the specific paper feed tray for the print job only, and automatically selects a paper feed tray to be used for other data from paper feed trays excluding the specific paper feed tray.

4 Claims, 6 Drawing Sheets

FIG.5

CORRESPONDENCE RELATIONSHIP BETWEEN FRONT AND BACK OF PAPER PLACED IN PAPER FEED TRAY AND FRONT AND BACK OF PAPER OUTPUT FROM PAPER OUTPUT TRAY

| | FED PAPER | PAPER OUTPUT OPENING | TWO-SIDE SETTING | STAPLE SETTING | OUTPUT PAPER | PAPER OUTPUT ORDER | REMARKS |
|---|---|---|---|---|---|---|---|
| PAPER FEED BASE | FRONT SIDE | FD | ONE SIDE | - | BACK SIDE | ASCENDING ORDER | PAPER OUTPUT IN ORDER FROM FIRST ITEM OF PRINTED MATTER |
| | | | TWO SIDES | - | FRONT SIDE | ASCENDING ORDER | FIRST ITEM PRINTED ON BACK SIDE OF OUTPUT PAPER, SECOND ITEM PRINTED ON FRONT SIDE OF OUTPUT PAPER |
| | | FU | ONE SIDE | OFF | FRONT SIDE | DESCENDING ORDER | PAPER OUTPUT IN ORDER FROM FINAL ITEM (N ITEM) OF PRINTED MATTER |
| | | | | ON | BACK SIDE | ASCENDING ORDER | PAPER OUTPUT IN ORDER FROM FIRST ITEM OF PRINTED MATTER |
| | | | TWO SIDES | OFF | BACK SIDE | DESCENDING ORDER | N ITEM PRINTED ON BACK SIDE OF OUTPUT PAPER, N-1 ITEM PRINTED ON FRONT SIDE OF OUTPUT PAPER |
| | | | | ON | BACK SIDE | ASCENDING ORDER | FIRST ITEM PRINTED ON BACK SIDE OF OUTPUT PAPER, SECOND ITEM PRINTED ON FRONT SIDE OF OUTPUT PAPER |
| TRAY 1 | FRONT SIDE | FD | ONE SIDE | - | FRONT SIDE | ASCENDING ORDER | PAPER OUTPUT IN ORDER FROM FIRST ITEM OF PRINTED MATTER |
| | | | TWO SIDES | - | BACK SIDE | ASCENDING ORDER | FIRST ITEM PRINTED ON BACK SIDE OF OUTPUT PAPER, SECOND ITEM PRINTED ON FRONT SIDE OF OUTPUT PAPER |
| | | FU | ONE SIDE | OFF | BACK SIDE | DESCENDING ORDER | PAPER OUTPUT IN ORDER FROM FINAL ITEM (N ITEM) OF PRINTED MATTER |
| | | | | ON | FRONT SIDE | ASCENDING ORDER | PAPER OUTPUT IN ORDER FROM FIRST ITEM OF PRINTED MATTER |
| | | | TWO SIDES | OFF | FRONT SIDE | DESCENDING ORDER | N ITEM PRINTED ON BACK SIDE OF OUTPUT PAPER, N-1 ITEM PRINTED ON FRONT SIDE OF OUTPUT PAPER |
| | | | | ON | FRONT SIDE | ASCENDING ORDER | FIRST ITEM PRINTED ON BACK SIDE OF OUTPUT PAPER, SECOND ITEM PRINTED ON FRONT SIDE OF OUTPUT PAPER |
| TRAY 2 | FRONT SIDE | FD | ONE SIDE | - | FRONT SIDE | ASCENDING ORDER | PAPER OUTPUT IN ORDER FROM FIRST ITEM OF PRINTED MATTER |
| | | | TWO SIDES | - | BACK SIDE | ASCENDING ORDER | FIRST ITEM PRINTED ON BACK SIDE OF OUTPUT PAPER, SECOND ITEM PRINTED ON FRONT SIDE OF OUTPUT PAPER |
| | | FU | ONE SIDE | OFF | BACK SIDE | DESCENDING ORDER | PAPER OUTPUT IN ORDER FROM FINAL ITEM (N ITEM) OF PRINTED MATTER |
| | | | | ON | FRONT SIDE | ASCENDING ORDER | PAPER OUTPUT IN ORDER FROM FIRST ITEM OF PRINTED MATTER |
| | | | TWO SIDES | OFF | FRONT SIDE | DESCENDING ORDER | N ITEM PRINTED ON BACK SIDE OF OUTPUT PAPER, N-1 ITEM PRINTED ON FRONT SIDE OF OUTPUT PAPER |
| | | | | ON | FRONT SIDE | ASCENDING ORDER | FIRST ITEM PRINTED ON BACK SIDE OF OUTPUT PAPER, SECOND ITEM PRINTED ON FRONT SIDE OF OUTPUT PAPER |
| TRAY 3 | FRONT SIDE | FD | ONE SIDE | - | FRONT SIDE | ASCENDING ORDER | PAPER OUTPUT IN ORDER FROM FIRST ITEM OF PRINTED MATTER |
| | | | TWO SIDES | - | BACK SIDE | ASCENDING ORDER | FIRST ITEM PRINTED ON BACK SIDE OF OUTPUT PAPER, SECOND ITEM PRINTED ON FRONT SIDE OF OUTPUT PAPER |
| | | FU | ONE SIDE | OFF | BACK SIDE | DESCENDING ORDER | PAPER OUTPUT IN ORDER FROM FINAL ITEM (N ITEM) OF PRINTED MATTER |
| | | | | ON | FRONT SIDE | ASCENDING ORDER | PAPER OUTPUT IN ORDER FROM FIRST ITEM OF PRINTED MATTER |
| | | | TWO SIDES | OFF | FRONT SIDE | DESCENDING ORDER | N ITEM PRINTED ON BACK SIDE OF OUTPUT PAPER, N-1 ITEM PRINTED ON FRONT SIDE OF OUTPUT PAPER |
| | | | | ON | FRONT SIDE | ASCENDING ORDER | FIRST ITEM PRINTED ON BACK SIDE OF OUTPUT PAPER, SECOND ITEM PRINTED ON FRONT SIDE OF OUTPUT PAPER |

※ THE BACK SIDE OF THE FED PAPER CORRESPONDS TO A SIDE OF THE OUTPUT PAPER OPPOSITE TO THE FRONT SIDE.

※ AS THERE IS NO RELEVANCE TO THE STAPLE SETTING WHEN THE PAPER OUTPUT OPENING IS FD, THIS IS DENOTED BY "-".

IMAGE FORMING DEVICE

BACKGROUND OF THE INVENTION

1. Technical Field

The present invention relates to an image forming device, and in particular, relates to an image forming device that has a print medium feed tray automatic selection function.

2. Related Art

To date, there has been known an image forming device that, when compiling a booklet in-line, can compile a cover only using a print medium differing from that used for contents (JP-A-2002-244493).

Also, there is known an image forming device with which it is possible to set category information for print media contained in each of plural paper feed trays included in the image forming device (JP-A-2007-076791).

Furthermore, there is known an image forming device that has an automatic tray selection function (a function corresponding to a paper feed tray automatic selection function).

The automatic tray selection function (the paper feed tray automatic selection function) is a function whereby, when a print job is received, the device itself automatically selects a paper feed tray in which is contained a print medium of a size appropriate to be used in a print job printing process from plural paper feed trays included in the image forming device (JP-A-2003-276288).

When compiling one finished article using plural print media, like the heretofore mentioned booklet, there is a need for a dedicated paper feed tray containing a print medium used as a cover, or the like, to be inserted in a specific place.

In this case, it is conceivable to set and store the print media contained in each paper feed tray in the device itself, as described in JP-A-2007-076791, and provide a dedicated tray that contains a print medium used in printing in a specific place, but it is often the case that this kind of print medium is a special paper, which is infrequently used in a normal printing process. Having to keep a dedicated paper feed tray for this purpose means keeping a paper feed tray that is not normally used, which leads to a restriction of the device functions.

SUMMARY OF THE INVENTION

In order to solve the heretofore described problem, an object of the invention is to provide an image forming device with which is obtained a finished article using plural print media in one print job, without providing a dedicated print medium feed tray for a special print medium.

In order to achieve the heretofore described object, a first image forming device according to the invention includes a print medium feed unit formed of plural print medium feed trays wherein a different kind of print medium is contained in each print medium feed tray, a communication unit that receives a print job formed of plural items of data using at least two different kinds of print media, a print job analysis unit that analyses setting information of the print job, and a print medium feed tray selection unit that, when a result of an analysis by the print job analysis unit is that the use of a specific print medium feed tray is designated for one portion of data among the data in the print job, selects the designated print medium feed tray from among the plural print medium feed trays as the specific print medium feed tray for the print job only, and automatically selects a print medium feed tray to be used for other data from print medium feed trays excluding the specific print medium feed tray.

Herein, kinds of print medium include, but is not limited to, the type of print medium such as paper, film, an envelope, a transparent plastic, and the like, the size of the print medium, thickness, basis weight, glossiness, and whether or not the print medium is a dedicated print medium for inkjet printing, or the like.

Hereinafter, for sake of convenience, the feed trays may be referred to as paper feed trays or the like. A paper feed tray is not intended to be limited to paper as the print medium disposed therein, but instead includes any type or kind of print medium to be printed on that can be disposed within the feed tray.

In order to achieve the heretofore described object, a second image forming device according to the invention is such that the first image forming device further includes a print job group setting unit that sets as a print job group plural print jobs of which it is determined as a result of an analysis by the print job analysis unit that print job user information is the same, wherein the paper feed tray selection unit excludes the paper feed tray set for the print job group only as the specific paper feed tray in the print job group from candidates as a paper feed tray automatic selection for other data in the print job group.

In order to achieve the heretofore described object, a third image forming device according to the invention is such that the first and second image forming devices further include a completion detection unit that detects the completion of the print job or print job group processing, wherein, when the completion detection unit detects that a processing is completed, the paper feed tray selection unit cancels the exclusion of the specific paper feed tray from the candidates as a paper feed tray automatic selection.

According to the first image forming device according to the invention, the print job analysis unit that analyses a print job received by the image forming device is provided, and by the paper feed tray selection unit being able to distinguish between a specific paper feed tray and other paper feed trays based on a result of an analysis by the print job analysis unit, the paper feed tray selection unit can select a paper feed tray appropriate for that print job alone. Therefore, as it is sufficient that a user selects a specific paper feed tray relating to his or her job, and causes the paper feed tray to contain special paper or other print medium, a dedicated paper feed tray for special paper is no longer provided.

Also, the paper feed tray selection unit excludes the specific paper feed tray, assuming that the special paper or other print medium is contained therein, from candidates for automatic selection when the paper feed tray selection unit itself selects a paper feed tray for data other than the data for which the special paper is used. Therefore, there is no longer any wasteful use of the special paper or other print medium either.

According to the second image forming device according to the invention, it is possible, by further including the print job group setting unit, to respond to the demands of a user who wishes to execute the processing of plural print jobs at one time, and/or wishes to obtain the finished articles formed of plural print jobs at one time.

Also, at this time too, as a paper feed tray designated as a specific paper feed tray in the print job group is excluded from the automatic tray selection candidates, there is no longer any wasteful use of special paper or other print medium.

According to the characteristics of the third image forming device according to the invention, as the exclusion of the specific paper feed tray from the automatic selection targets is cancelled by the completion of the print job processing, that is, the specific paper feed tray is included in the selection target trays for automatic paper feed tray selection, it is possible to regard the use as a specific tray as being limited to a print job or print job group, and a dedicated paper feed tray for special paper or other print medium is no longer provided.

BRIEF DESCRIPTION OF THE DRAWINGS

FIG. 5 is a diagram showing a correspondence relationship between the front and back of a print medium placed in a paper feed tray and the front and back of paper output from a discharge tray.

DETAILED DESCRIPTION OF THE EMBODIMENTS

Figure 1:
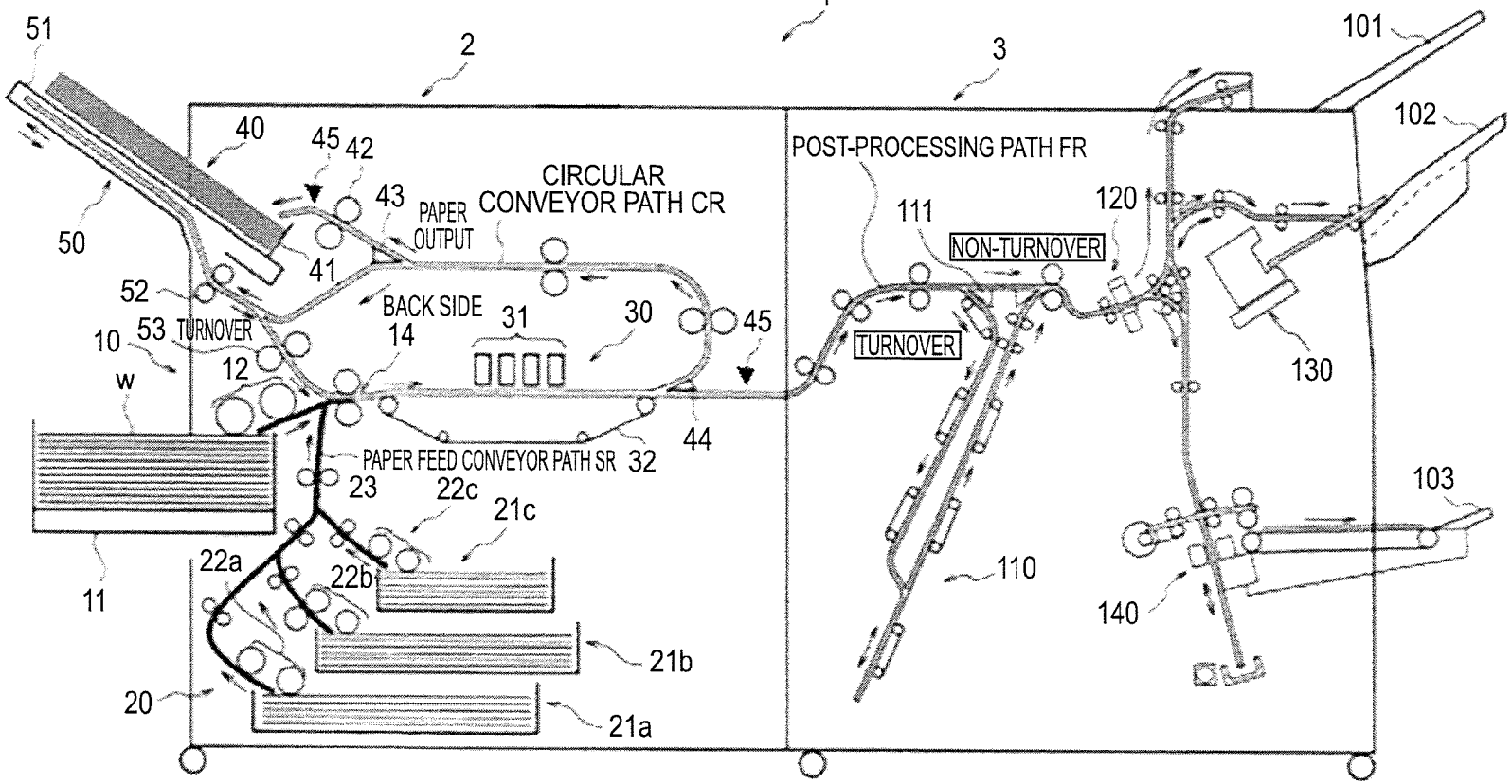
FIG. 1 is an overall configuration diagram showing an overall configuration of an image forming device connected to a post-processing device.

Hereafter, a description will be given, referring to the drawings, of embodiments of the invention.

Configuration of Image Forming Device and System Connected Thereto

FIG. 1 is a diagram showing an overall configuration of an image forming device, which is one embodiment of the invention, connected to a finisher, which is a post-processing device.

As shown in FIG. 1, an image forming system 1 includes an image forming device 2, which executes a printing on a print medium W, and a post-processing device 3, which receives the print medium W printed by the image forming device 2 and executes a post-processing on the print medium W. Herein, the print medium W may be any kind of article, including paper, film, an envelope, a transparent plastic, and the like, provided that it can be conveyed inside the image forming device 2 and post-processing device 3. Hereinafter, for sake of convenience, the feed trays containing the print medium may be referred to as paper feed trays or the like. A paper feed tray is not intended to be limited to paper as the print medium disposed therein, but instead includes any type or kind of print medium to be printed on that can be disposed within the feed tray.

The image forming device 2 includes a side paper feed tray 10 typified by a manual feed tray, an internal paper feed tray 20, a printing unit (image forming unit) 30, a paper output unit 40, and a turnover unit 50.

The side paper feed tray 10 includes a paper feed base 11 on which the print media W are stacked, a primary paper feed unit 12, which causes only the print medium W in the uppermost position to be conveyed from the paper feed base 11 onto a paper feed conveyor path SR, and a secondary paper feed unit 14, which receives the print medium W conveyed by the primary paper feed unit 12, and conveys it onto a circular conveyor path CR.

By the print medium W conveyed onto the paper feed conveyor path SR by the primary paper feed unit 12 being brought into contact with the secondary paper feed unit 14, and slack being formed, positioning of the leading edge of the print medium W and an oblique movement correction are carried out, after which, the print medium W is conveyed at a predetermined timing toward the printing unit 30 on the circular conveyor path CR.

The internal paper feed tray 20 includes paper feed trays 21*a*, 21*b*, and 21*c*, on which the print media W are stacked, and primary paper feed units 22*a*, 22*b*, and 22*c*, which cause only the print media W in the uppermost positions to be conveyed from the paper feed trays 21*a*, 21*b*, and 21*c* onto the paper feed conveyor path SR.

Each of the print media W conveyed onto the paper feed conveyor path SR by the primary paper feed units 22*a*, 22*b*, and 22*c* is conveyed on the paper feed conveyor path SR by plural conveyor rollers, such as a conveyor roller 23, installed on the paper feed conveyor path SR, and brought into contact with the secondary paper feed unit 14. By so doing, slack is formed in the print medium W, positioning of the leading edge of the print medium W and an oblique movement correction are carried out owing to the slack, and subsequently, the print medium W is conveyed at a predetermined timing toward the printing unit 30 on the circular conveyor path CR.

In this way, the print medium W is conveyed from the side paper feed tray 10 and internal paper feed tray 20 to the secondary paper feed unit 14, and furthermore, the print medium W is also conveyed from the turnover unit 50, to be described hereafter. Because of this, there exists before the secondary paper feed unit 14 in the conveying direction a junction, which is a convergence of the conveyor path of the fed print medium W and a path on which paper to be printed on the back side, which has been circularly conveyed inside the device and turned over by the turnover unit 50 after being printed on the front side, is conveyed after circulating. With the junction as a reference, the path on the paper feed mechanism side is called the paper feed conveyor path SR, and the path on which the print medium W is circulated inside the image forming device 2 is called the circular conveyor path CR.

The printing unit 30 includes a head unit 31, in which plural print heads are fitted, and a circular conveyor belt 32 provided opposing the head unit 31.

While the print medium W fed by the secondary paper feed unit 14 is conveyed on the conveyor belt 32 at a speed fixed in accordance with printing conditions, printing is performed in line units on the print medium W with ink ejected from the head unit 31.

The print medium W printed by the printing unit 30 is conveyed on the circular conveyor path CR inside the housing by conveyor rollers, and the like, disposed on the circular conveyor path CR.

A switching mechanism 43, which switches between directing the print medium W conveyed on the circular conveyor path CR to the upper side paper output unit 40 and causing the print medium W to circulate on the circular conveyor path CR again, is provided on the circular conveyor path CR.

The upper side paper output unit 40 has a paper output tray 41 of a tray form protruding from the housing of the image forming device 2, and a pair of paper output rollers 42 that direct the print medium 41 to the paper output tray 41.

Then, the print medium W directed to the upper side paper output unit 40 by the switching mechanism 43 is conveyed to the paper output tray 41 by the paper output rollers 42, and stacked in the paper output tray 41 with the side printed immediately before being conveyed facing down.

The upper side paper output unit 40 is a so-called face down type of paper output base.

The turnover unit 50 includes a turnover base 51 that turns over the print medium W, and a turnover roller 52 that conveys the print medium W from the circular conveyor path CR to the turnover base 51, or conveys the print medium W from the turnover base 51 to the circular conveyor path CR.

The print medium W directed to the turnover unit 50 by the switching mechanism 43 is conveyed from the circular conveyor path CR to the turnover base 51 by the turnover roller 52 and, after a predetermined time elapses, the front and back of the print medium W are reversed with respect to the circular conveyor path CR by the print medium W being conveyed from the turnover base 51 to the circular conveyor path CR.

Then, the print medium W whose front and back have been reversed is conveyed on the circular conveyor path CR by plural rollers, such as a conveyor roller 53, provided on the circular conveyor path CR, and brought into contact with the secondary paper feed unit 14.

By so doing, slack is formed in the print medium W, positioning of the leading edge of the print medium W and an oblique movement correction are carried out by a control causing the slack to be formed, and subsequently, the print medium W is conveyed at a predetermined timing toward the printing unit 30 on the circular conveyor path CR.

Also, a switching mechanism 44 is provided on the circular conveyor path CR and, when a post-processing is to be carried out on the print medium W, the print medium W is directed to the post-processing device 3 by the switching mechanism 44 switching the conveying direction.

In a stand-alone image forming device, a portion after the switching mechanism 44 connecting to the post-processing device 3 is used as a straight paper output unit which, as a print medium is discharged with the side printed immediately before facing up, is known as a face up type of paper output unit. When the post-processing device 3 is not connected to the image forming device 2, a paper output tray is connected, and the portion is used as a straight paper output unit.

When a post-processing after a one-side printing is designated, the print medium W is discharged from the image forming device 2 by the switching mechanism 44 after one side has been printed by the printing unit 30, while when an post-processing after a two-side printing is designated, the print medium printed on one side (the front side) is printed on the other side (the back side) by the printing unit 30 after being turned over by the turnover unit 50, and subsequently discharged from the image forming device 2 by the switching mechanism 44, and directed to the post-processing device 3.

The post-processing device 3 includes a turnover unit 110 that can reverse the front and back of the conveyed print medium W.

For those of the print media W conveyed to the post-processing device 3 whose front and back need reversing, a switching mechanism 111 switches in such a way as to direct the print medium W to the turnover unit 110 at the bottom of FIG. 1, while for print media W whose front and back do not need reversing, the switching mechanism 111 switches in such a way as to direct the print medium W in a downstream straight direction.

For example, a punch processing unit 120, a staple processing unit 130, and a centerfold processing unit 140 are provided on the conveying direction downstream side of the turnover unit 110 as post-processing units that execute a post-processing.

Regardless of whether or not there is a front and back reversal, the print medium W conveyed downstream of the turnover unit 110 is conveyed to the punch processing unit 120, staple processing unit 130, or centerfold processing unit 140, depending on a user's print job settings.

A punch processing whereby a punch hole is bored through the print medium W in accordance with a print job is executed in the punch processing unit 120, and the print medium W is conveyed in the direction of a downstream top tray 101, stacker tray 102, or stacker tray 103.

The print medium W conveyed in the direction of the top tray 101 is stacked on the top tray 101, while the print medium W conveyed in the direction of the stacker tray 102 is stacked on the stacker tray 102 after a staple processing is executed by the staple processing unit 130 in accordance with a long edge binding or short edge binding position.

The print medium W conveyed in the direction of the stacker tray 103 is stacked on the stacker tray 103 after a centerfold processing is executed by the centerfold processing unit 140.

Functional Configuration of Image Forming Device and System Connected Thereto

Figure 2:
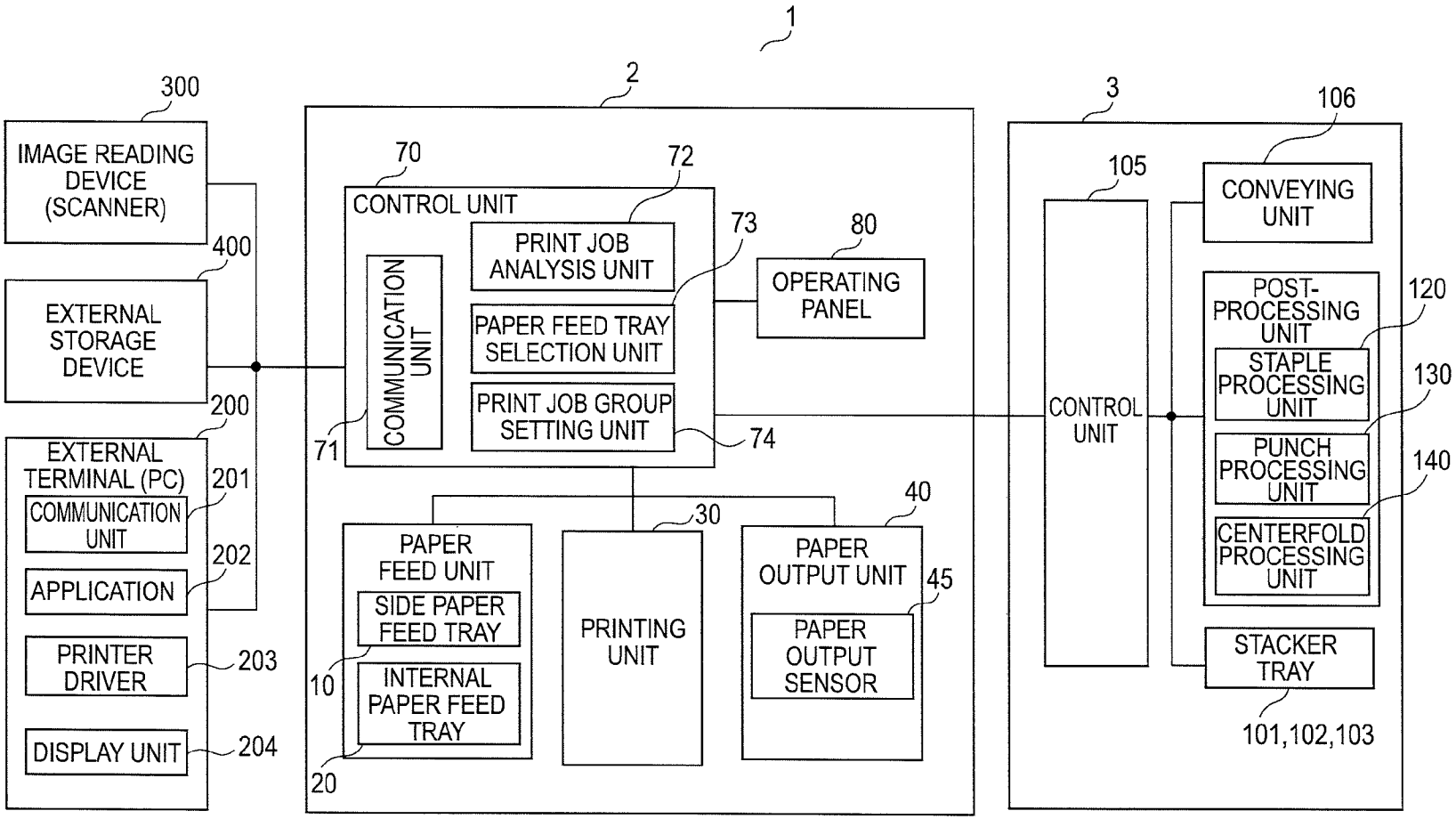
FIG. 2 is a functional configuration diagram showing a functional configuration of the image forming device and each device connected thereto.

FIG. 2 is a block diagram representing a functional configuration of the image forming device, which is one embodiment of the invention, and each device connected thereto. Hereafter, in order to avoid a redundant description, a description of the previously described configuration will be omitted.

The image forming device 2 is connected to the post-processing device 3, an external terminal 200, an image reading device 300, and the like, configuring the image forming system 1.

Control units 70 and 105 are portions responsible for controlling operations in each of the image forming device 2 and post-processing device 3.

Also, the control unit 70 pertaining to the image forming device 2 includes as functions thereof functions as a communication unit 71, a print job analysis unit 72, a paper feed tray selection unit 73, and a print job group setting unit 74.

The communication unit 71 receives a print job, or print data relating to a print job, from the image reading device 300, the external terminal 200, and an external storage device 400, to be described hereafter. Also, when necessary, the communication unit 71 can also send data to each device connected to the image forming device 2.

The print job analysis unit 72 carries out an analysis of setting information (job setting) of a print job received by the communication unit. Specifically, the print job analysis unit 72 analyses the size setting of the print medium W to be used, whether or not plural print media W are needed, whether or not a specific paper feed tray is selected in the data in the print job, whether the printing is a one-side printing or a two-side printing, whether the printing is monochrome or color, whether a change in magnification is designated, and whether conveying to the post-processing device 3 is necessary (whether conveying is necessary in either the upper side paper output direction or straight paper output direction). Also, the print job analysis unit also carries out a determination of a paper output order (printing order) of the data in the analyzed print job in accordance with print job analysis results, in particular, whether or not there is a post-processing and the paper output destination. Furthermore, when necessary, the print job analysis unit also carries out an acquisition of information on the user who has transmitted the print job.

The paper feed tray selection unit 73 selects the paper feed tray to be used in the print job based on the result of the analysis by the print job analysis unit.

Specifically, when the print job is to use the plural print media, and the use of a specific paper feed tray for one portion of the data has been selected, the paper feed tray selection unit 73 sets that paper feed tray as a specific paper feed tray.

Then, regarding print data in the print job for which no paper feed tray has been designated, the paper feed tray selection unit 73, based on the print job analysis unit analysis results, automatically selects a paper feed tray appropriate for processing the print job from among the paper feed trays other than the paper feed tray set as the specific paper feed tray.

The print job group setting unit 74, when the communication unit 71 receives plural print jobs, sets print jobs, among the jobs received, determined as the result of an analysis by the print job analysis unit 72 to have been sent by the same user as a print job group, which is one collection of jobs. The print job group setting unit 74, not being necessary in a first embodiment, to be described hereafter, is used in a second embodiment.

An operating panel 80 has a transparent pressure-sensitive or electrostatic touch panel disposed on the front surface, and a liquid crystal display panel (neither shown in the drawing) disposed on the rear surface of the touch panel.

The user, by directly touching the panel surface with a finger, or the like, while looking at the display screen of the operating panel 80, can carry out various kinds of setting input operations, such as an operation for starting a printing, whether or not there is to be a post-processing, such as a punch processing, staple processing, or centerfold processing, or a covering, and a setting operation setting a selection of a paper feed tray to be used when executing a print job.

Also, the image forming device 2 is connected to the external terminal 200 and image reading device 300 so that a transmitting and receiving of data, be it wireless or wired, is possible, and connection to the external storage device 400 is also possible.

The external terminal 200 is a commonly-known personal computer including a communication unit 201 that can carry out a transmission and reception of data with an external device, an application 202 that can compile print data on the external terminal 200, a printer driver 203 that carries out processes controlling the image forming device 2, and a display unit 204.

The printer driver 203 displays a print setting screen and the like on the display unit 204, receives a setting relating to a printing from the user, and notifies the user of information relating to a printing.

The user can select a print setting necessary for his or her print job via the display unit 204. This is, for example, whether or not there is to be a post-processing or covering, and a selection of a paper feed tray to be used when executing the print job.

The user, on finishing the print setting, can transmit the print job to the image forming device 2 using the external terminal 200. At this time, the printer driver 203 can include user information in the print job. It being sufficient that the user information includes information that can identify the user, it may be, for example, an IP address.

The external storage device 400 may be, for example, a portable storage device such as a USB memory. The user can store data he or she wishes to print, and send the data to the image forming device 2 by connecting the external storage device 400 to the image forming device 2.

The image reading device 300 is normally provided in an upper portion of the image forming device 2 and, although not shown in the drawing, includes a contact glass on which a manuscript is placed, a cover provided so that it can come into contact with and separate from the contact glass, a scanning unit that scans a manuscript placed on the contact glass, a lens that focuses scanned images, and an image processing unit that processes focused images.

Then, the image forming device 2 reads image data for executing a printing by the scanning unit scanning the manuscript placed on the contact glass line by line, and the printing unit 30 processing the scanned images.

The user can start processing of a print job after adding a print setting from the operating panel 80 to print data obtained by connecting the external storage device to the image forming device in a condition in which print data relating to the print job are stored in the external storage device 400, or by reading a manuscript image using the image reading device 300.

Print Setting with Printer Driver

Figure 3A:
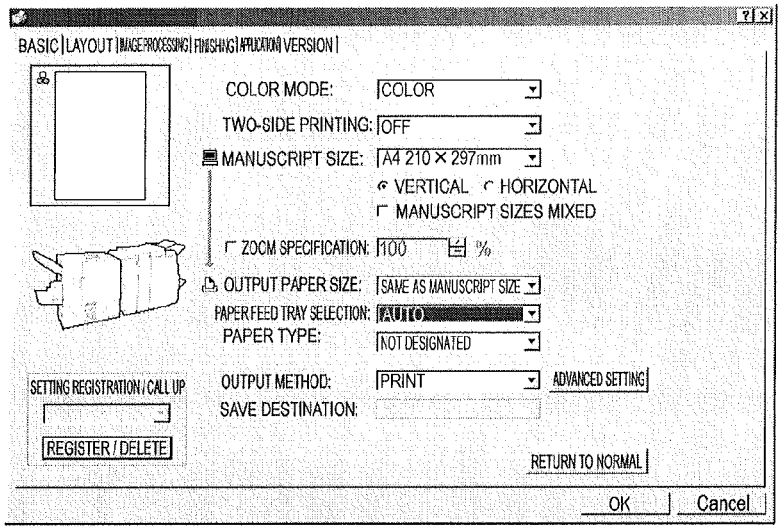
FIGS. 3A to 3C are diagrams showing examples of print setting screens.
Figure 3B:
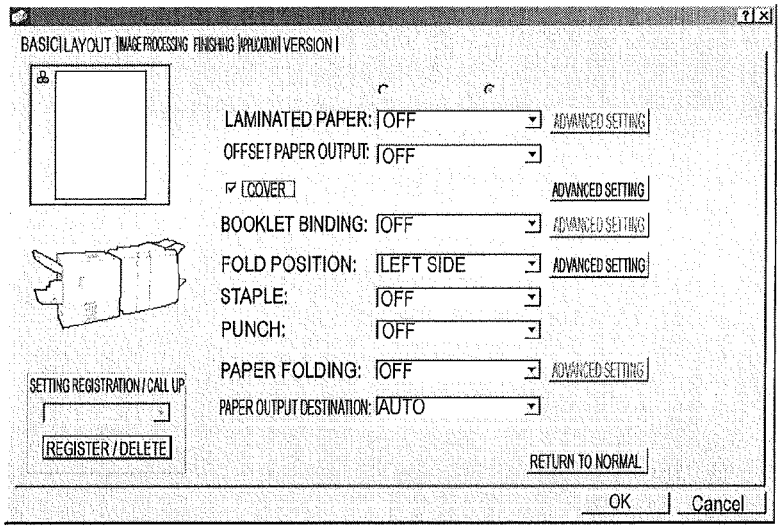
Figure 3C:
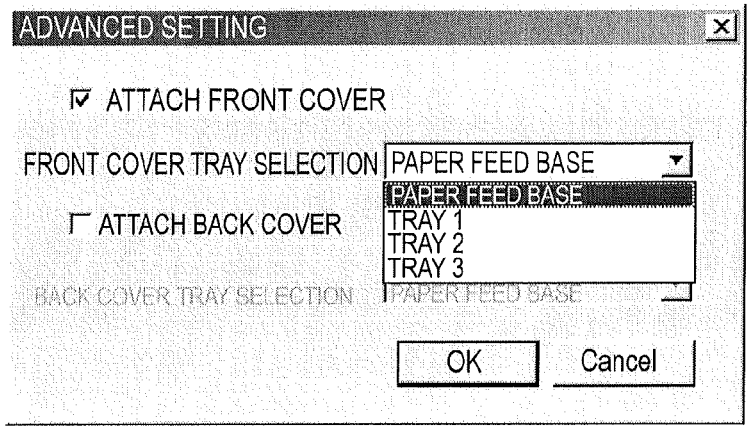

FIGS. 3A to 3C are diagrams showing screens displayed on the display unit 204 when starting up the printer driver 203 on the external terminal 200 and setting a print job.

Various kinds of jobs are conceivable as print jobs using differing print media W. These include, for example, a print job configured of a cover (a front cover and/or a back cover) and contents, and a print job configured of plural printed media and a laminated paper inserted among the media in order to indicate a division between portions.

As one example in the embodiment, a description will be given of a case of accepting the execution of a print job wherein settings are such that a front cover is inserted, differing print media W are used for the front cover and the printed contents, and the media are to be discharged without using the post-processing device.

The user compiles print data using the application 202, and starts up the printer driver 203 when printing. The display screen of the display unit 204 immediately after the printer driver 203 starts up is such that a screen when a "Basic" tab is selected is displayed, as shown in FIG. 3A.

The user, via this screen, can set the paper feed tray he or she wishes to use in the printing from the side paper feed tray 10 or one of the internal paper feed trays 20*a* to 20*c*. "Auto" is displayed as the paper feed tray selection in FIG. 3A, and in the event that there is no paper feed tray specification from the user, "Auto" is selected. "Auto" refers to a paper feed tray automatic selection function itself.

Next, when a "Finishing" tab is selected by the user, the screen shown in FIG. 3B is displayed. As shown in FIG. 3B, a "Cover" checkbox is selected when the user wishes to carry out a covering of the printed articles. When "Cover" is selected, a check mark is entered in the checkbox by a CPU of the external terminal 200.

Then, when "Cover" is selected, the display screen automatically shifts to the screen of FIG. 3C. Although it is assumed here that there is an automatic shift to the screen of FIG. 3C when the "Cover" checkbox is checked, it may also be arranged that there is a shift when the user selects "Advanced Setting" to the right of "Cover".

As checkboxes for "Attach Front Cover" and "Attach Back Cover" are prepared, as in FIG. 3C, the user can set a desired processing by selecting one or both of the checkboxes. Also, it is also possible to designate plural paper feed trays as specific paper feed trays.

Herein, it is assumed that "Attach Front Cover" is set, and a check mark is entered in the relevant checkbox. By the user selecting one paper feed tray from "Paper Feed Base", "Tray 1", "Tray 2", and "Tray 3" called up by clicking on a selection portion (a ▼ button in the drawing) on the right, the paper feed tray to be used for feeding a front cover is selected. Herein, "Paper Feed Base" represents the side paper feed tray 10, and "Trays 1 to 3" represent the internal paper feed trays 22*a* to 22*c*. In the embodiment, it is assumed that the user selects the paper feed base (the side paper feed tray 10).

By carrying out a print job print setting using the printer driver 203 as heretofore described, the user can set his or her desired setting.

The above description has been giving assuming that the print setting is carried out on the external terminal 200. However, this can be used as it is as a print setting on the operating panel 80. By the user carrying out a setting on the operating panel 80 using print data read using the image reading device 300, or stored in the external storage device 400, it is possible to carry out a setting desired by the user, in the same way as when setting using the external terminal 200. It is necessary that information on the setting screen and the like is stored in an unshown storage unit of the image forming device 2.

Working of Image Forming Device

Figure 4:
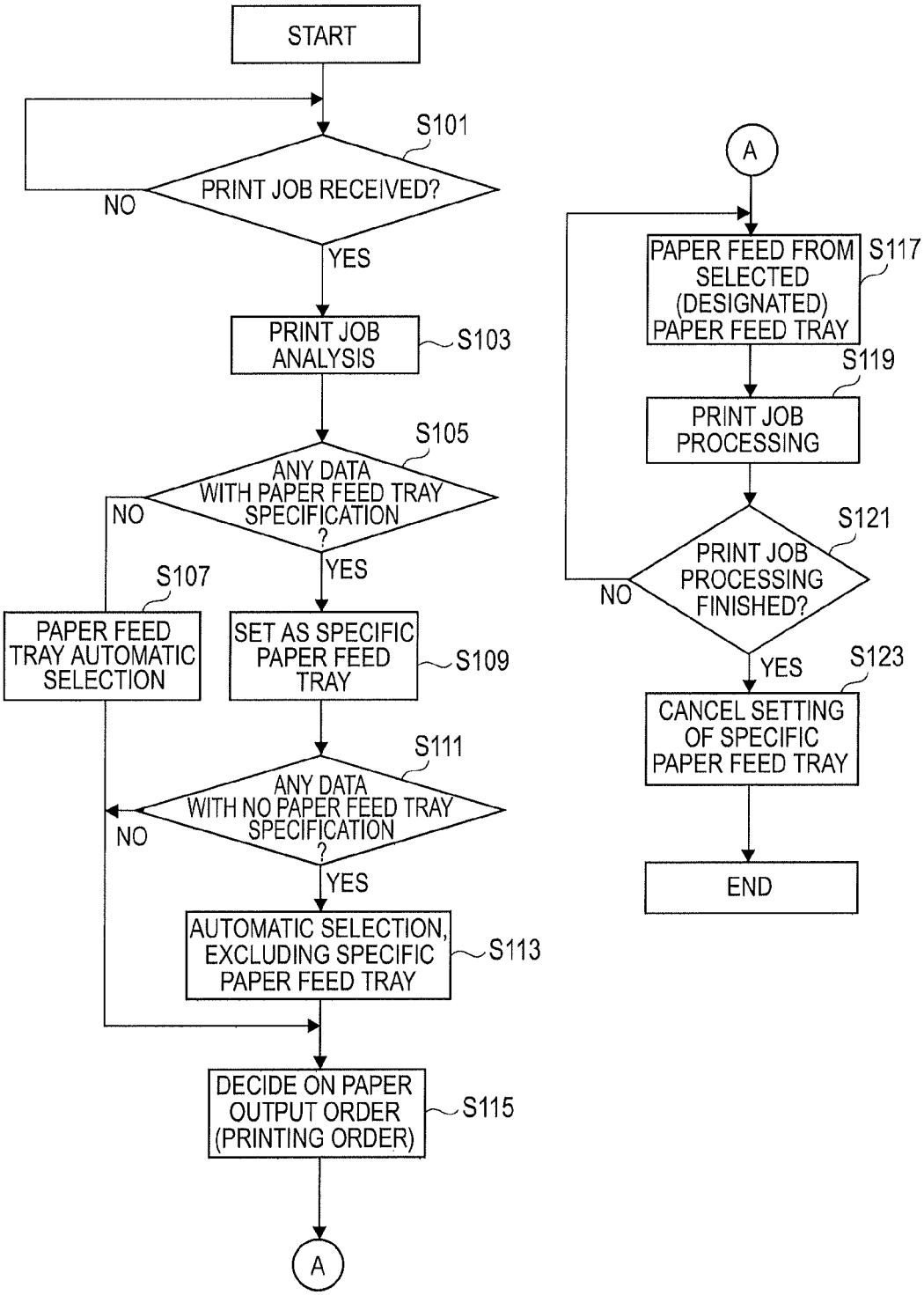
FIG. 4 is a diagram showing a control flow in the image forming device according to a first embodiment.

FIG. 4 is a diagram showing a control flow in the image forming device 2 of the embodiment. The image forming device 2 according to the first embodiment will be described assuming that there has been received a print job for which the print setting described using, in particular, FIGS. 3A to 3C has been carried out. It is assumed that a "Front Cover" which has already been printed is placed with the front side facing up in the side paper feed tray 10.

It is determined whether or not the communication unit 71 of the image forming device 2 has received a print job (S101). If the communication unit 71 receives a print job (S101; Yes), the print job analysis unit 72 analyzes the print setting set in the print job (S103). In the embodiment, the print job analysis unit 72 analyzes, in particular, paper size information of the print medium W needed for a printing of the print data in the print job, whether or not there are print data for which a paper feed tray is designated, whether the discharge destination of the print medium W discharged from the image forming device 2 is the upper side paper output direction or straight paper output direction, and whether the setting is such that the post-processing device 3 is to be used (S103).

If, based on the result of the analysis by the print job analysis unit 72, print data for which a paper feed tray is designated do not exist in the print job (S105; No), the paper feed tray selection unit 73, using the paper size information and the like in the print job, searches for a paper feed tray containing the print medium W of the same size as that in the paper size information, and automatically selects and sets it as the paper feed tray to be used in processing the print job received (S107).

If, meanwhile, based on the result of the analysis by the print job analysis unit 72, print data for which a paper feed tray is designated exist in the print job (S105; Yes), the paper feed tray selection unit 73 sets (selects) the designated paper feed tray as the specific paper feed tray (S109).

As described using FIGS. 3A to 3C, the print job in the embodiment is such that a "Front Cover" is added to the print data forming the contents of the finished article and, as the paper feed base (the side paper feed tray 10) is designated as the paper feed tray to be used for the front cover, the side paper feed tray 10 is the specific tray.

Subsequently, the print job analysis unit 72 determines whether or not there are no print data for which no paper feed tray is designated in the print job (S111).

If there are no print data for which no paper feed tray is designated (S111; No), it means that a paper feed tray is designated for the print job as a whole, and the process is shifted to step S115.

Meanwhile, if there are print data for which no paper feed tray is designated (S111; Yes), a paper feed tray to be used for the items of print data for which no paper feed tray is designated is automatically selected by the paper feed tray selection unit 73 (S113). At this time, as it is predicted that the side paper feed tray 10 set by the paper feed tray selection unit as the specific paper feed tray contains the dedicated print medium W that is to form the "Front Cover", the paper feed tray selection unit 73 selects the paper feed tray after excluding the side paper feed tray 10, which is the specific paper feed tray, from the candidates as the paper feed tray automatic selection.

The paper feed trays to be used in processing the print job are decided on in steps S107 and S113 described above.

Subsequently, the print job analysis unit 72, based on the results of the print job analysis, decides on the discharge order, which is the order in which the printed media W are discharged from the image forming device 2 (the printing order, and therefore the order of the print media W fed from the paper feeding trays). The discharge order is decided on based on the direction in which the print medium W is output (a straight paper output direction, which is a face up (FU) paper output, or an upper side paper output direction, which is a face down (FD) paper output), the setting of the paper to be inserted (for example, a front cover or a back cover), and the like.

FIG. 5 shows details relating to the discharge order. As FIG. 5 does not use the turnover unit 110 of the post-processing device 3, that is, as it is assumed that the print medium W is conveyed in a straight direction without being turned over, no turnover unit 110 item is provided.

This table may be stored in a non-volatile storage medium provided in the image forming device 2, or it may be stored in the external terminal 200 as a function of the printer driver 203, and the relevant discharge order information extracted and transmitted included in the print setting when transmitting a print job.

In the embodiment, it is assumed that the "Front Cover" is placed with the front side facing up in the paper feed base (the side paper feed tray 10), the upper side paper output portion 40, whose paper output opening is face down (FD), is designated as the paper output portion because no post-processing is necessary, and a one-side printing is set in the printing data. Because of this, the back sides of all the output paper (the discharged print media W) are facing up, and the output order is such that the "Front Cover" is to be output first, after which the print media W are to be discharged in ascending order. That is, it will be the topmost setting of FIG. 5. In this way, the print job analysis unit 72 can decide on an appropriate output order in accordance with the print job settings, and the like.

When the output order has been decided on, the control unit 70 executes a printing process in accordance with the output order. Specifically, the control unit 70, in accordance with the output order, feeds the print medium W from the designated paper feed tray by controlling the paper feed unit, conveys the print medium W by controlling a conveying unit, appropriately carries out a printing process on the print medium W conveyed by the conveying unit by controlling the printing unit 30, carries out a two-side printing when necessary by controlling the turnover unit 50, and discharges the print medium W to the designated paper output destination by controlling the paper output unit.

In particular, when feeding the print medium W, based on the result of the analysis by the print job analysis unit 72 and the result of the paper feed tray selection by the paper feed tray selection unit 73, a paper feed from appropriate paper feed trays is carried out by the control unit in order that the output order is that desired by the user. More specifically, as a front cover insertion setting is carried out in FIGS. 3A to 3C, and the paper feed base (the side paper feed tray 10) is selected as the specific paper feed tray, the print medium W is fed from the paper feed base when conveying the front cover. For print data other than the front cover, for which no paper feed tray is designated, a feed is carried out from a paper feed tray automatically selected by the paper feed tray selection unit 73, based on the paper size information of the print job, from among the paper feed trays (the paper feed trays 21*a* to 21*c* of the internal paper feed tray 20) other than the paper feed base (the side paper feed tray 10), which is the specific paper feed tray.

A paper output sensor 45 is provided in a vicinity upstream of the discharge opening of both the upper side paper output unit 40 and straight paper output unit, the paper output sensor 45 detects whether or not the output of the number of the print media W designated by the print job is completed, and the control unit counts the number. When it is detected that the number of the print media W designated by the print job has passed the paper output sensor 45 (S121; Yes), the paper feed tray selection unit 73 cancels the setting of the paper feed tray set as the specific paper feed tray (S123), finishing the printing process. In other words, the paper feed tray selection unit 73 can include all the paper feed trays as targets for an automatic paper feed tray selection for a print job received immediately after the completed print job, in which no paper feed tray is designated.

As heretofore described, the image forming device 2 is such that the print job analysis unit 72 that analyses a print job received via the communication unit 71 is provided, and by the paper feed tray selection unit 73 being able to distinguish between a specific paper feed tray and other paper feed trays based on a result of an analysis by the print job analysis unit 72, the paper feed tray selection unit 73 can select a paper feed tray appropriate for the process for that print job alone. Therefore, as it is sufficient that the user selects a specific paper feed tray relating to his or her job, and causes the paper feed tray to contain special paper, a dedicated paper feed tray for special paper is no longer provided.

Also, as the paper feed tray selection unit 73 excludes the specific paper feed tray, assuming that the special paper is contained therein, from the candidates for paper feed tray automatic selection for data other than the data for which the special paper is used, there is no longer any wasteful use of the special paper either.

Furthermore, the completion of the print job is detected by providing the paper output sensor 45 and counting the number of the print media W discharged from the image forming device 2, the exclusion of the specific paper feed tray from the automatic selection targets is cancelled as a result of the detection of the completion of the print job, and the specific paper feed tray is included in the paper feed trays that are targets for automatic selection.

Because of this, it is possible to regard the use as a specific tray as being limited to a print job, and a dedicated paper feed tray for special paper is no longer provided.

The print medium W used for a cover or laminated paper may be white paper in order that it can be printed by the printing unit 30 based on print data in the print job, or it may be an article on which the necessary printing has already been carried out that is inserted in an appropriate place.

Second Embodiment

A difference between the second embodiment and the first embodiment is whether or not a process is carried out after setting a print job group when the image forming device 2 receives plural print jobs. Consequently, a description of components described in the first embodiment will be omitted in order to avoid a redundant description.

Figure 6:
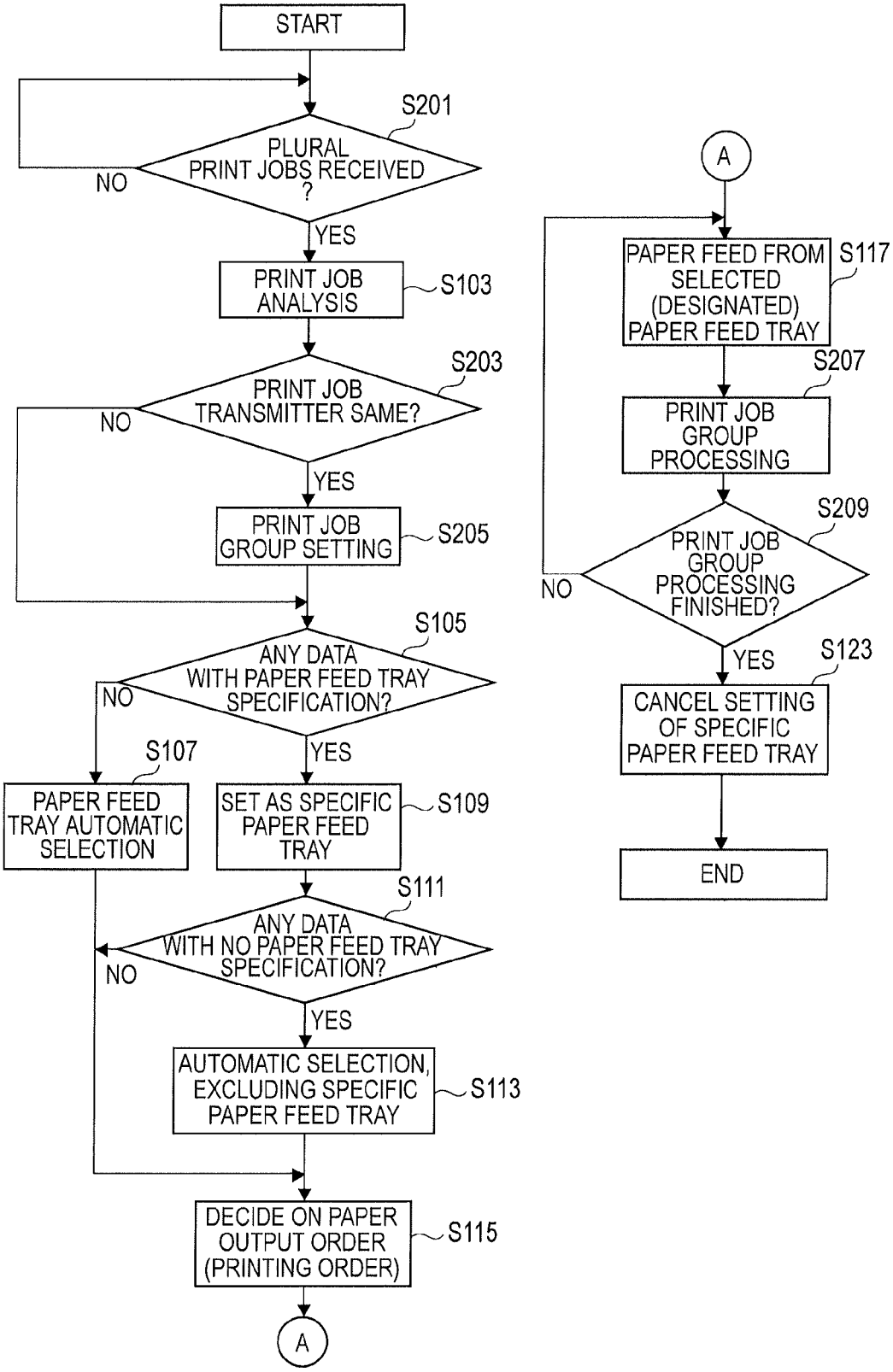
FIG. 6 is a diagram showing a control flow in an image forming device according to a second embodiment.

The print job group setting unit 74 shown in the block diagram of FIG. 2, when the user of plural items of print jobs received by the image forming device 2 via the communication unit 71 is the same, sets the plural print jobs as a print job group, which is one collection of jobs. Hereafter, a description will be given of the image forming device 2 according to the second embodiment, using the control flow of FIG. 6.

When receiving plural print jobs via the communication unit 71 (S201; Yes), the print job analysis unit 72 analyses the plural print jobs (S103). In the image forming device 2 according to the second embodiment, the print job analysis unit 72, as well as analyzing whether or not the same settings as in the image forming device 2 according to the first embodiment exist, analyses in particular whether or not the user (transmission source) of the plural print jobs received is the same.

As a process is carried out for each print job when the print jobs have different users, a description will be omitted as the control flow is the same as that of the already described FIG. 4.

If it is determined by the print job analysis unit 73 that the user of the plural print jobs is the same, the print job group setting unit 74 sets the plural print jobs with the same user as a print job group, which is one collection of jobs (S205). At this time, the print job group setting unit 74 acquires the quantity to be printed for each print job, and calculates the total quantity to be printed for the print job group.

For subsequent steps, it is sufficient that the print job described in the first embodiment is rewritten as a print job group. That is, step S105 becomes "Whether or not there are print data for which a paper feed tray is designated "in the print job group"", while step S111 becomes "Whether or not there exist print data for which no paper feed tray is designated "in the print job group"". Also, step S119, becoming step S207, becomes "Processing "the print job group"", while step S121, becoming step S209, becomes "It is determined whether or not the processing of "the print job group" is completed". Herein, the control unit 70 determines whether or not the processing of the print job group is completed based on whether or not the number of times the print medium W is detected by the paper output sensor 45 reaches a number equivalent to the total quantity to be printed calculated by the print job group setting unit 74.

As heretofore described, with the image forming device 2 according to the second embodiment, it is possible, by further including the print job group setting unit 74 in the image forming device 2 according to the first embodiment, to respond to the demands of a user who wishes to execute the processing of plural print jobs at one time, and/or wishes to obtain the finished articles according to plural print jobs at one time.

Also, at this time too, as a paper feed tray designated as a specific paper feed tray in the print job group is excluded from the automatic tray selection targets when selecting a paper feed tray for data for which no paper feed tray has been selected, there is no longer any wasteful use of special paper or other print medium.

Other Embodiments

The image forming device 2 according to the first embodiment and second embodiment may also be provided with a so-called authenticated printing function. The authenticated printing function is a function whereby the user, after transmitting a print job, passes an authentication card over an unshown authentication device connected to the image forming device 2 in front of the image forming device 2, or inputs a password from the operating panel 80, and the image forming device 2 starts printing the print job when the person transmitting the print job and the person printing are the same. By providing this function, the user, after transmitting a print job, can place special paper or other print medium in a specific paper feed tray, and start printing by using the authenticating function.

Also, with the image forming device 2 according to the first embodiment and second embodiment, when a specific paper feed tray setting has been carried out, the specific paper feed tray setting is cancelled as a result of the completion of a print job or print job group processing. However, other methods may also be used.

For example, a method may be used whereby there is provided a paper detecting sensor that detects whether or not the print medium W is in a paper feed tray set as a specific paper feed tray, and the setting is cancelled when there is no more of the print medium W in the paper feed tray.

Also, a method may be used whereby the specific paper feed tray setting is cancelled when the specific paper feed tray is pulled out of the image forming device 2.

Although a description has been given using the post-processing device 3 in the embodiments according to the invention, the post-processing device 3 is not essential. This is because, provided that a finished article is discharged in the upper side paper output unit or straight paper output unit in the image forming device 2 to which the post-processing device 3 is not connected, the user himself or herself can carry out necessary work such as a staple processing.

What is claimed is:

1. An image forming device, comprising:

a print medium feed unit formed of a plurality of print medium feed trays wherein a different kind of print medium is contained in each print medium feed tray;

a communication unit that receives a print job formed of a plurality of items of data using at least two different kinds of print media;

a print job analysis unit that analyses setting information of the print job; and a print medium feed tray selection unit that, when a result of an analysis by the print job analysis unit is that the use of a specific print medium feed tray is designated for one portion of data among the data in the print job, selects the designated print medium feed tray from among the plurality of print medium feed trays as the specific print medium feed tray for the print job only, and automatically selects a print medium feed tray to be used for other data from print medium feed trays excluding the specific print medium feed tray.

2. The image forming device according to claim 1, further comprising:

a print job group setting unit that sets as a print job group a plurality of print jobs of which it is determined as a result of an analysis by the print job analysis unit that print job user information is the same, wherein the print medium feed tray selection unit excludes the print medium feed tray set for the print job group only as the specific print medium feed tray in the print job group from candidates as a print medium feed tray automatic selection for other data in the print job group.

3. The image forming device according to claim 1, further comprising:

a completion detection unit that detects the completion of the print job or print job group processing, wherein when the completion detection unit detects that a processing is completed, the print medium feed tray selection unit cancels the exclusion of the specific print medium feed tray from the candidates as a print medium feed tray automatic selection.

4. The image forming device according to claim 1, wherein the print medium contained in each print medium feed tray is paper.

* * * * *